United States Patent [19]

Le Coent et al.

[11] Patent Number: 4,470,916

[45] Date of Patent: Sep. 11, 1984

[54] HIGH ALKALINITY METALLIC DETERGENT-DISPERSANT ADDITIVES FOR LUBRICATING OILS AND METHOD OF MAKING SAME

[75] Inventors: Jean-Louis Le Coent, Le Havre; Bernard Demoures, Puteaux, both of France

[73] Assignee: Orogil, Courbevoie, France

[21] Appl. No.: 506,774

[22] Filed: Jun. 22, 1983

[30] Foreign Application Priority Data

Jun. 24, 1982 [FR] France ..... 82 11059

[51] Int. Cl.[3] ..... C10M 1/40

[52] U.S. Cl. ..... 252/33.4; 252/18; 252/40.7; 252/42.7

[58] Field of Search ..... 252/18, 33.4, 39, 40.7, 252/42.7

[56] References Cited

U.S. PATENT DOCUMENTS

| | | | |
|---|---|---|---|
| 3,256,186 | 6/1966 | Greenwald | 252/33 |
| 3,282,835 | 11/1966 | Asseff | 252/33.2 |
| 3,464,970 | 9/1969 | Sakai et al. | 260/137 |
| 3,509,053 | 4/1970 | Branch | 252/18 |
| 3,862,981 | 1/1975 | Demoures et al. | 260/479 S |
| 3,928,216 | 12/1975 | Saunders et al. | 252/18 |
| 3,936,480 | 2/1976 | Demoures et al. | 260/404.5 |
| 3,966,621 | 6/1976 | Watkins et al. | 252/42.7 |
| 4,016,093 | 4/1977 | Koft, Jr. | 254/42.7 |
| 4,042,514 | 8/1977 | Giolito et al. | 252/48.6 |
| 4,049,560 | 9/1977 | Dominey | 252/18 |
| 4,222,882 | 9/1980 | Brulet et al. | 252/51.5 |
| 4,229,308 | 10/1980 | Brulet et al. | 252/47 |
| 4,251,379 | 2/1981 | Le Coent et al. | 252/33 |
| 4,293,431 | 8/1981 | Demoures et al. | 252/18 |
| 4,302,342 | 11/1981 | Demoures et al. | 252/18 |
| 4,382,004 | 5/1983 | Tassara | 252/25 |

FOREIGN PATENT DOCUMENTS

| | | |
|---|---|---|
| 793197 | 6/1979 | South Africa . |
| 1144084 | 3/1969 | United Kingdom . |
| 1280749 | 7/1972 | United Kingdom . |

*Primary Examiner*—Jacqueline V. Howard

[57] ABSTRACT

High alkalinity metallic lubricating oil additives and a method of making them are disclosed. A magnesium alkylbenzenesulfonate and a sulfurized calcium alkylphenate are carbonated in the presence of an oil, magnesium oxide, a glycol, and an amine. The glycol, water, and sediment are then removed from the resulting medium.

26 Claims, No Drawings

HIGH ALKALINITY METALLIC DETERGENT-DISPERSANT ADDITIVES FOR LUBRICATING OILS AND METHOD OF MAKING SAME

BACKGROUND OF THE INVENTION

The present invention relates to a method of preparing metallic additives of high alkalinity useful in improving the detergent and dispersant properties of lubricating oils, and additives produced by such method.

It is known to add various compounds to lubricating oils to improve the properties of such oils. U.S. Pat. No. 4,251,379 discloses a high alkalinity additive for lubricating oils prepared by first sulfurizing an alkylphenol in the presence of an alkylbenzene sulfonate of low or zero Total Basic Number (T.B.N.), an alkaline earth base, and an alkylene glycol, precarbonating the mixture thus obtained, super-alkalinizing and carbonating the resultant precarbonated mixture by means of an alkaline earth base, $CO_2$, and an alkylene glycol, and eliminating the excess alkylene glycol.

U.S. Pat. No. 4,382,004 discloses magnesium alkylphenates useful as additives for lubricating oils obtained by preparing a suspension of active magnesium oxide in methanol, contacting the suspension with a mixture containing an alkylphenol bearing one or more $C_6$–$C_{60}$ alkyl substituents, a dilution oil, and optionally, a heavy alcohol having a boiling point between 100° and 200° C., the ratio or number of moles of active magnesium oxide to number of recurrent phenolic OH units being between about 0.25 and 2, and carbonating the resultant medium under pressure with carbon dioxide.

SUMMARY OF THE INVENTION

The present invention relates to a method of making metallic additives of high alkalinity, according to which a magnesium alkylbenzenesulfonate and a sulfurized calcium alkylphenate are carbonated in the presence of an oil, magnesium oxide, a glycol, and an amine, and the glycol, water, and sediment are removed.

The additives prepared according to this method are further characterized by a T.B.N. of at least 225, contain more than about 3.8% by weight of magnesium, and contain from about 2% to about 3% by weight of calcium. The additives of the present invention have the advantages of being compatible with viscous oils, of containing only a small proportion of sediment, and of having low viscosity. These additives have been found capable of improving the detergent, dispersant, and anti-wear properties of lubricating oils.

DETAILED DESCRIPTION OF THE INVENTION

In one preferred embodiment, the method of the invention comprises the steps of:

(a) preparing a reaction medium comprising a magnesium alkylbenzenesulfonate with a T.B.N. up to about 20, a sulfurized calcium alkylphenate with a T.B.N. up to about 200, and a dilution oil;

(b) carbonating the reaction medium in the presence of a milk of magnesia mixture comprising active magnesium oxide, a glycol, and an amine;

(c) removing the glycol and the water from the medium, preferably by distillation; and (d) removing sediment from the medium, preferably by filtration.

In a second preferred embodiment, carbonation step (b) is preceded by precarbonating the reaction medium in the presence of a glycol and optionally sulfur.

As used herein, the term "magnesium alkylbenzenesulfonate" refer to any solution containing from about 25% to about 80% by weight, preferably from about 30% to about 70% by weight, of a magnesium alkylbenzenesulfonate in an oil which may or may not be the same as the dilution oil.

Among the magnesium alkylbenzenesulfonates useful in the present invention are the magnesium salts of sulfonic acids obtained by sulfonation of alkylbenzenes derived from $C_{15}$–$C_{30}$ olefins or olefin polymers.

As used herein, the term "sulfurized calcium alkylphenate" refers to any solution containing from about 25% to about 70% by weight, preferably from about 30% to about 55% by weight, of a sulfurized calcium alkylphenate in an oil which may or may not be the same as the dilution oil.

Among the sulfurized calcium alkylphenates useful in the present invention are those obtained by the reaction of lime with a sulfurized alkylphenol, preferably a sulfurized alkylphenol having one or a plurality of alkyl substituents of $C_9$–$C_{30}$, more preferably on the order of $C_9$–$C_{22}$ such as the sulfurized nonyl, decyl, dodecyl or tetradecyl-phenols, the reaction optionally being followed by a carbonation step; those obtained by sulfurizing an alkylphenol in the presence of lime and glycol, preferably an alkylphenol having one or a plurality of alkyl substituents of $C_9$–$C_{30}$, more preferably on the order of $C_9$–$C_{22}$, the sulfurization optionally being followed by a carbonation step.

As used herein, the term "active" magnesium oxide refers to magnesium oxide (MgO) with a specific surface greater than or equal to 80 $m^2/g$, for example, between 100 $m^2/g$ and 170 $m^2/g$.

Active magnesium oxides useful in the invention include "Maglite DE," which has a specific surface of close to 140 $m^2/g$ (marketed by Merck & Co.), and "Ferumag," which has a specific surface close to 160 $m^2/g$ (marketed by Rhone-Poulenc).

Amines useful in the present invention include polyaminoalkanes, preferably polyaminoethanes, particularly ethylenediamine, and aminoethers, particularly tris(3-oxa-6-aminohexyl) amine. The amine may be added prior to or during the carbonation.

The dilution oils useful in the present invention include naphthenic oils and mixed oils, and preferably paraffinic oils such as neutral 100 oil. The quantity of dilution oil used is such that the amount of oil in the final product (including that originating from the initial magnesium alkylbenzenesulfonate) constitutes from about 20% to about 60% by weight of the final product, preferably from about 25% to about 55% and, more preferably, from about 30% to about 45%.

The glycols useful in the present invention include alkylene glycols, particularly ethylene glycol.

One preferred method of making the additives of the present invention is to use reagents in amounts so that:

the ratio of the quantity of magnesium alkylbenzenesulfonate, expressed in moles of alkylbenzenesulfonic acid, to the quantity of sulfurized calcium alkylphenate, expressed in moles of alkylphenol, is from about 0.15 to about 5.5, preferably from about 0.25 to about 2;

the quantity of active MgO corresponds to a "base ratio" (that is, the ratio of the number of moles of basic magnesium, i.e., not fixed to the alkylbenzenesulfonic acid, to the number of moles of non-basic magnesium, i.e., fixed to the alkylbenzenesulfonic acid) of from about 5 to about 14, preferably from about 7 to about 11;

the quantity of glycol corresponds to an MgO to glycol molar ratio of from about 0.1 to about 0.7, preferably from about 0.1 to about 0.65;

the quantity of amine is such that the ratio of moles of amine to moles of basic magnesium is from about 0.01 to about 0.4, preferably from about 0.04 to about 0.25; and the sulfurized calcium alkylphenate used is characterized by a molar ratio of lime to alkylphenol of from about 0.2 to about 2.5, preferably from about 0.4 to about 2, and a molar ratio of sulfur to alkylphenol of from about 1.1 to about 2.2, preferably from about 1.3 to about 1.8.

The carbonation is preferably carried out in one or more stages at a temperature of from about 90° to about 140° C., preferably from about 110° to about 140° C. The milk of magnesia mixture is added to the medium containing the magnesium alkylbenzenesulfonate, sulfurized calcium alkylphenate, and dilution oil, in one or more stages, each stage of addition of milk of magnesia mixture being followed by carbonation. Toward the end of the overall carbonation step it is advantageous to add a quantity of water corresponding to a water to MgO weight ratio of from about 0.1 to about 0.9. The carbonation is continued until the sediment rate is stabilized, usually a maximum of six hours.

In another preferred method, the carbonation step is preceded by precarbonating the reaction medium comprised of the magnesium alkylbenzene sulfonate, sulfurized calcium alkylphenate, and dilution oil, in the presence of a glycol and optionally sulfur. Precarbonation is preferably performed at a temperature of from about 150° to about 180° C., more preferably from about 160° to about 175° C., in the presence of the following:

a quantity of glycol so that the molar ratio of calcium to glycol is from about 0.15 to about 0.77, preferably from about 0.2 to about 0.6;

a quantity of $CO_2$ so that the molar ratio of $CO_2$ to calcium is from about 0.2 to about 0.8, preferably from about 0.4 to about 0.65; and optionally, a quantity of sulfur so that the molar ratio of sulfur to calcium is from about 0 to about 1.5, preferably from about 0 to about 1;

The quantity of additive of this invention to be used with a particular lubricating oil depends on the intended use of the oil. Thus, for an oil for a gasoline engine, the quantity of additive to be employed is generally from about 1% to about 3.5%; for an oil for a diesel engine, the quantity of additive is generally from about 1.8% to about 5%; and for an oil for a marine engine, the quantity of additive may range up to about 25%.

A great variety of lubricating oils can be improved with the additives of the present invention. These oils include naphtha-based, paraffin-based, and mixed-based lubricating oils and other hydrocarbon-based lubricants, for example, lubricating oils derived from coal products and synthetic oils such as alkylene polymers, alkyleneoxide-type polymers, and their derivatives, including the alkyleneoxide polymers prepared by polymerizing alkylene oxide in the presence of water or alcohols, for example, ethyl alcohol, the esters of dicarboxylic acids, liquid esters of phosphorus acids, alkylbenzenes and dialkylbenzenes, polyphenyls, alkylbiphenylethers, and silicon polymers.

Other additives may also be added to the lubricating oils, for example, anti-oxidant additives, anti-corrosion additives, and ashless dispersant additives.

The following examples present illustrative but non-limiting embodiments of this invention.

EXAMPLES

Characteristics Of The Product.

In these experiments, product characteristics were measured according to the following procedures:

1. Measurement of the amount of sediment

The amount of sediment was determined according to ASTM Standard D 2273-67, with the following modifications:

a. Rotational speed of the centrifuge: 6,000 rpm;

b. Relative centrifugal force: 10,000;

c. The product to be analyzed was diluted to a ratio of 1:4 with gasoline E (25 $cm^3$ of product to be analyzed to 75 $cm^3$ of gasoline E);

d. Duration of centrifuging: 10 minutes.

2. Compatibility tests a. No. 1

This test was carried out by adding 10% of the product to be tested to an SAE (Society of Automotive Engineers) 30 mineral oil, storing the resulting solution for 1 month at 20° C., and examining the appearance of the solution as a function of time.

Scoring:

1 for a clear and brilliant product 2 for a very slightly turbid product 3 for a turbid product b. No. 2

The finished product was added to an SAE 50 oil of paraffinic tendency to obtain a solution containing 125 millimoles of calcium plus magnesium.

The solution was stored for 24 hours, then centrifuged under the following conditions:

(1) Rotational speed: 6,000 rpm;

(2) Relative centrifugal force: 10,000;

(3) Duration of centrifuging: 1 hour.

The amount of sediment was then measured.

General Description Of Additive Preparation (A) Preparation of a magnesium alkylbenzenesulfonate of a T.B.N.=3

A 3-liter flask is charged with:

(a) an about 70% solution of sulfonic acid in neutral 100 dilution oil, said sulfonic acid having an approximate molecular weight of 470 (sodium salt mass); and (b) neutral 100 dilution oil.

The reaction medium is heated to 80° C. and the following items are added:

(c) a quantity of "Maglite DE" so as to obtain a magnesium alkylbenzenesulfonate with a T.B.N. of approximately 3; and (d) ethylene glycol (added over a 5 minute period).

The reaction medium is then heated for 30 minutes at 110° C. at atmospheric pressure and then for 30 minutes under a vacuum of $133 \times 10^2$ Pa to distill off the water of reaction.

(B) Preparation of sulfurized calcium alkylphenate

The reaction flask from step A is then charged, at 110° C., with the following:

(a) sulfurized dodecylphenol (DDP) containing approximately 11% by weight of sulfur;

(b) slaked lime; and (c) ethylene glycol (added over a 5 minute period).

The resultant medium is heated for 90 minutes at 120° C. at atmospheric pressure and then for 30 minutes under a vacuum of $120\times10^2$ Pa. The vacuum is then terminated.

(C) Carbonation

A milk of magnesia mixture is prepared by mixing active magnesium oxide, ethylene glycol, and an amine in a beaker with contant stirring. The milk of magnesia mixture thus prepared is subdivided into three relatively equal fractions and carbonation of the reaction medium is carried out by:

(a) adding the first fraction of the milk of magnesia to the flask containing the medium to be carbonated, introducing $CO_2$ at a temperature of about 110° C., and carbonating for 2 hours;

(b) adding the second fraction of milk of magnesia to the medium, introducing $CO_2$ at a temperature of about 110° C. and carbonating for another 2 hours; and finally (c) adding the third fraction of milk of magnesia to the medium along with water and the carbonating for 2 more hours.

(D) Removal of glycol and water

Once the carbonation is stopped, the ethylene glycol and the water are distilled off by gradually placing the reaction flask under a vacuum of $40\times10^2$ Pa and heating at 200° C. for two hours.

(E) Filtration

The product medium is then filtered to remove sediment.

Examples 1 through 9

The reaction conditions for Examples 1 through 9 are as described above. The quantities of reagents used in the different steps of Examples 1 through 9 are summarized in Tables I and II; the results obtained are summarized in Table II.

TABLE I

| | EXAMPLES | | | | | | | | |
|---|---|---|---|---|---|---|---|---|---|
| | 1 | 2 | 3 | 4 | 5 | 6 | 7 | 8* | 9 |
| Step A | | | | | | | | | |
| Sulfonic acid solution, g | 500 | 500 | 500 | 500 | 700 | 400 | 500 | 500 | 500 |
| Oil, g | 615 | 615 | 615 | 615 | 700 | 615 | 615 | 615 | 615 |
| MgO, g | 19 | 19 | 19 | 19 | 27 | 10 | 19 | 19 | 19 |
| $CaCl_2$ solution, g | 4 | 4 | 4 | 4 | 12 | 4 | 4 | 4 | 4 |
| Ethylene glycol, g | 38 | 38 | 38 | 38 | 81 | 20 | 38 | 38 | 38 |
| Sediment, % | 0.3 | 0.3 | 0.3 | 0.3 | 0.4 | 0.3 | 0.4 | 0.3 | 0.4 |
| Step B | | | | | | | | | |
| Sulfurized DDP, g | 419 | 419 | 419 | 419 | 136 | 550 | 419 | 419 | 419 |
| Lime, g | 100 | 100 | 100 | 100 | 70 | 100 | 100 | 100 | 100 |
| Ethylene glycol, g | 100 | 100 | 100 | 100 | 80 | 100 | 100 | 100 | 100 |
| Sediment, % | 0.9 | 0.9 | 0.9 | 0.9 | 0.5 | 0.4 | 0.6 | 0.9 | 0.9 |

*Comparative

TABLE II

| | EXAMPLES | | | | | | | | |
|---|---|---|---|---|---|---|---|---|---|
| | 1 | 2 | 3 | 4 | 5 | 6 | 7 | 8** | 9 |
| Step C | | | | | | | | | |
| MgO, g | 129 | 129 | 129 | 129 | 200 | 129 | 129 | 129 | 160 |
| Ethylene glycol, g | 390 | 390 | 390 | 390 | 500 | 390 | 390 | 390 | 460 |
| Ethylenediamine, g | 16.5 | 16.5 | 33 | 8.5 | 25 | 16.5 | — | — | 19.5 |
| TOA, g | — | — | — | — | — | — | 16.5 | — | — |
| $H_2O$, g | 85 | 106 24 | 85 | 85 | 112 | 85 | 85 | 85 | 100 |
| $CO_2$, g | 180 | 180 | 180 | 180 | 260 | 190 | 180 | 190 | 212 |
| Sediment, % | 2.5 | 3 | 2.5 | 2.9 | 3.3 | 3.1 | 2.7 | 7 | 2.7 |
| Analysis of End Product | | | | | | | | | |
| Sediment, % | 0.08 | 0.08 | 0.08 | 0.08 | 0.08 | 0.06 | 0.09 | 0.2 | 0.15 |
| Mg, % | 4.4 | 4.36 | 4.44 | 4.35 | 5.2 | 4.3 | 4.38 | 3.5 | 5.1 |
| Ca, % | 3.0 | 3.0 | 3.0 | 3.0 | 2.4 | 2.95 | 3 | 2.8 | 2.9 |
| Viscosity at 100° C., cst | 310 | 304 | 340 | 325 | 430 | 322 | 296 | 410 | 380 |
| T.B.N. | 264 | 259 | 266 | 264 | 270 | 258 | 262 | 218 | 281 |
| Compatibility Tests: | | | | | | | | | |
| No. 1 | 1 | 1 | 1 | 1 | 1 | 1 | 1 | 2 | 1 |
| No. 2 | * | * | * | * | * | * | * | 2 | * |

*Trace amounts.
**Comparative

Example 10

In Example 10, the reaction conditions were also as described above. In this Example, the different steps described in Example 1 were carried out by replacing the 16.5 g of ethylenediamine with 8 g of tris(3-oxa-6-aminohexyl)amine (TOA). The results were identical to those obtained for Example 1.

Example 11

The reagents used and steps carried out in Example 11 were the same as those in Example 1. The reaction conditions were the same as those described above wth the exception that the reaction temperature was 130° C. at the beginning of the carbonation step instead of 110° C. The results were also identical to those obtained for Example 1.

Example 12

(A) Preparation of magnesium alkylbenzenesulfonate of a T.B.N.=18

A 3-liter flask was charged with:

(a) 500 g of an about 70% solution of sulfonic acid in neutral 100 dilution oil, said sulfonic acid having a molecular weight of 470 (sodium salt mass);

(b) 615 g of neutral 100 dilution oil;

(c) 25 g of active magnesium oxide; and (d) 7 g of an about 50% aqueous calcium chloride solution.

The mixture was heated to 110° C. and 112 g of ethylene glycol were added during a 1 hour interval. Heating was continued until the reaction medium reached 160° C.

(B) Preparation of sulfurized calcium alkylphenate

The reaction flask from step A was then charged with 411 g of sulfurized dodecylphenol containing approximately 10% sulfur, 100 g of lime, and 45 g of sulfur. The flask was placed under a vacuum of $346.6\times10^2$ Pa and 100 g of ethylene glycol were introduced during a 1 hour interval with constant heating. The resultant mixture was then maintained at a temperature of about 165° C. under a pressure of $345\times10^2$ Pa for 1 hour.

(C) Precarbonation

The vacuum was broken, heating was halted, and the resultant mixture was carbonated for 1 hour at a $CO_2$ rate of 0.5 g/min.

(D) Carbonation

A mixture of 129 g of MgO and 349 g of ethylene glycol was prepared in a beaker and added to the reaction flask from step C over a period of five minutes. Next, $CO_2$ was introduced into the flask. After 2 hours, 16.5 g of ethylenediamine were added. Two hours later, 85 g of water were introduced into the flask and the carbonation was continued for another two hours. During the six hours of carbonation, the output of $CO_2$ was monitored to ensure the presence of a slight excess of $CO_2$ in the medium.

(E) Removal of glycol and water

The ethylene glycol and the water were removed by distilling the medium for two hours at a temperature of 200° C. under $40\times10^2$ Pa.

The amount of the crude sediment at the end of this step was about 2.3%.

(F) Filtration

The resultant mixture was then filtered to remove sediment.

| Analysis Of The End Product | |
|---|---|
| Ca | 3% |
| Mg | 4.4% |
| Sediment (after filtration) | 0.06% |
| Viscosity at 100° C. | 350 cst |
| T.B.N. | 266 |
| Compatibility Tests: | |
| No. 1 | 1 |
| No. 2 | 0.01% of sediment after centrifuging. |

Example 12 bis (Comparative)

In Example 12 bis, the same steps were carried out as in Example 12 but in the absence of amine. The results of this example were as follows:

| Analysis Of The End Product | |
|---|---|
| Sediment (Crude) | 6.5% |
| Ca | 2.9% |
| Mg | 3.2% |

-continued

| Analysis Of The End Product | |
|---|---|
| Sediment (after filtration) | 0.1% |
| Viscosity at 100° C. | 320 cst |
| T.B.N. | 210 |
| Compatibility Tests: | |
| No. 1 | 2 |
| No. 2 | 1.5 |

We claim:

1. A method of preparing a lubricating oil additive comprising the steps of:

(a) preparing a reaction medium comprising a magnesium alkylbenzenesulfonate having a T.B.N. up to about 20, a sulfurized calcium alkylphenate having a T.B.N. up to about 200, and a dilution oil;

(b) carbonating the reaction medium in the presence of a milk of magnesia mixture comprising active magnesium oxide, a glycol, and an amine;

(c) removing the glycol and the water from the medium; and (d) removing sediment from the medium.

2. The method of claim 1 wherein carbonation step (b) is carried out at a temperature of from about 90° to about 140° C.

3. The method of claim 1 wherein in step (b) the milk of magnesia mixture is added in separate portions to the mixture comprising the magnesium alkylbenzenesulfonate, sulfurized calcium alkylphenate, and dilution oil, and wherein each addition of a portion of the milk of magnesia mixture is followed by a carbonation step.

4. The method of claim 1 wherein in step (b), a quantity of water corresponding to a water to MgO weight ratio of from about 0.1 to about 0.9 is added toward the end of the carbonation.

5. The method of claim 1 wherein the sulfurized calcium alkylphenate has a lime to alkylphenol molar ratio of from about 0.2 to about 2.5, and a sulfur to alkylphenol molar ratio of from about 1.1 to about 2.2.

6. The method of claim 1 wherein the sulfurized calcium alkylphenate has a lime to alkylphenol molar ratio of from about 0.4 to about 2, and a sulfur to alkylphenol molar ratio of from about 1.3 to about 1.8.

7. The method of claim 1 wherein the amine is a polyaminoalkane.

8. The method of claim 7 wherein the amine is ethylenediamine.

9. The method of claim 1 wherein the amine is an aminoether.

10. The method of claim 9 wherein the aminoether is tris(3-oxa-6-aminohexyl)amine.

11. The method of claim 1 further comprising, after step (a), precarbonating the reaction medium in the presence of glycol.

12. A method of preparing a lubricating oil additive comprising the steps of:

(a) preparing a reaction mixture comprising a magnesium alkylbenzenesulfonate having a T.B.N. up to about 20, a sulfurized calcium alkylphenate having a T.B.N. up to about 200, and a dilution oil;

(b) precarbonating the reaction medium in the presence of glycol and sulfur;

(c) carbonating the reaction medium in the presence of a milk of magnesia mixture comprising active magnesium oxide, a glycol, and an amine;

(d) removing the glycol and the water from the medium; and (e) removing sediment from the medium.

13. The method of claim 12 wherein said precarbonation step is performed at a temperature of from about 150° to about 180° C.

14. The method of claim 12 wherein said precarbonation step is carried out in the presence of a quantity of glycol so as to yield a calcium to glycol molar ratio of from about 0.15 to about 0.77, a quantity of sulfur so as to yield a sulfur to calcium molar ratio of from about 0 to about 1.5, and a quantity of $CO_2$ so as to yield a $CO_2$ to calcium molar ratio of from about 0.2 to about 0.8.

15. The method of claim 14 wherein said precarbonation step is carried out in the presence of a quantity of glycol so as to yield a calcium to glycol molar ratio of from about 0.2 to about 0.6, a quantity of sulfur so as to yield a sulfur to calcium molar ratio of from about 0 to about 1, and a quantity of $CO_2$ so as to yield a $CO_2$ to calcium molar ratio of from about 0.4 to about 0.65.

16. A method of preparing an oil additive comprising the steps of:

(a) preparing a reaction medium comprising a quantity of magnesium alkylbenzenesulfonate having a T.B.N. up to about 20 so that the ratio of the amount of magnesium alkylbenzenesulfonate, expressed in moles of alkylbenzene sulfonic acid, to the amount of sulfurized calcium alkylphenate, expressed in moles of alkylphenol, is from about 0.15 to about 5.5, a sulfurized calcium alkylphenate having a T.B.N. up to about 200, and a dilution oil;

(b) carbonating the reaction medium in the presence of a milk of magnesia mixture comprising a quantity of active magnesium oxide so as to yield a base ratio of from about 5 to about 14, a quantity of glycol so as to yield a MgO to glycol molar ratio of from about 0.1 to about 0.7, and a quantity of amine so as to yield an amine to basic magnesium molar ratio of from about 0.01 to about 0.4;

(c) removing glycol and the water from the medium; and (d) removing sediment from the medium.

17. The method of claim 16 further comprising, after step (a), precarbonating the reaction medium in the presence of glycol.

18. The method of claim 16 further comprising, after step (a), precarbonating the reaction medium in the presence of glycol and sulfur.

19. The method of claim 18 wherein said precarbonation step is performed at a temperature of from about 150° to about 180° C.

20. A method of preparing a lubricating oil additive comprising the steps of:

(a) preparing a reaction medium comprising a quantity of magnesium alkylbenzenesulfonate having a T.B.N. up to about 20 so that the ratio of the amount of magnesium alkylbenzenesulfonate, expressed in moles of alkylbenzene sulfonic acid, to the amount of sulfurized calcium alkylphenate, expressed in moles of alkylphenol, is from about 0.25 to about 2, a sulfurized calcium alkylphenate having a T.B.N. up to about 200, and a dilution oil;

(b) carbonating the reaction medium in the presence of a milk of magnesia mixture comprising a quantity of active magnesium oxide so as to yield a base ratio of from about 7 to about 11, a quantity of glycol so as to yield a Mg to glycol molar ratio of from about 0.3 to about 0.65, and a quantity of amine so as to yield an amine to basic magnesium molar ratio of from about 0.4 to about 0.25;

(c) removing the glycol and the water from the medium; and (d) removing sediment from the medium.

21. The method of claim 20 further comprising, after step (a), precarbonating the reaction medium in the presence of glycol.

22. The method of claim 20 further comprising, after step (a), precarbonating the reaction medium in the presence of glycol and sulfur.

23. A lubricating oil additive prepared according to a method comprising the steps of:

(a) preparing a reaction medium comprising a magnesium alkylbenzenesulfonate having a T.B.N. up to about 20, a sulfurized calcium alkylphenate having a T.B.N. up to about 200, and a dilution oil;

(b) carbonating the reaction medium in the presence of a milk of magnesia mixture comprising active magnesium oxide, a glycol, and an amine;

(c) removing the glycol and the water from the medium; and (d) removing sediment from the medium.

24. A lubricating oil additive prepared according to a method of claim 23, said method further comprising, after step (a), precarbonating the reaction medium in the presence of glycol and sulfur.

25. A method of improving the detergent, dispersant, and anti-wear properties of lubricating oils, comprising adding to said oils an effective amount of the additive of claim 23.

26. A method of improving the detergent, dispersant, and anti-wear properties of lubricating oils, comprising adding to said oils an effective amount of the additive of claim 24.

* * * * *